US009176445B2

(12) United States Patent
Yoshikawa

(10) Patent No.: US 9,176,445 B2
(45) Date of Patent: Nov. 3, 2015

(54) FIXING DEVICE AND IMAGE FORMING APPARATUS INCORPORATING SAME

(71) Applicant: Takahiro Yoshikawa, Kanagawa (JP)

(72) Inventor: Takahiro Yoshikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 58 days.

(21) Appl. No.: 13/865,260

(22) Filed: Apr. 18, 2013

(65) Prior Publication Data

US 2013/0330110 A1 Dec. 12, 2013

(30) Foreign Application Priority Data

Jun. 6, 2012 (JP) ..... 2012-129279

(51) Int. Cl.
*G03G 15/20* (2006.01)

(52) U.S. Cl.
CPC ..... *G03G 15/2085* (2013.01); *G03G 15/2028* (2013.01)

(58) Field of Classification Search
CPC ..... G03G 15/2028; G03G 15/2085
USPC ..... 399/323
See application file for complete search history.

(56) References Cited

U.S. PATENT DOCUMENTS

| | | | | |
|---|---|---|---|---|
| 2004/0120735 | A1* | 6/2004 | Baba et al. | 399/323 |
| 2006/0133864 | A1* | 6/2006 | Tatematsu et al. | 399/320 |
| 2010/0046994 | A1* | 2/2010 | Kikuchi et al. | 399/320 |
| 2012/0044516 | A1* | 2/2012 | Hirose et al. | 358/1.13 |

FOREIGN PATENT DOCUMENTS

| | | |
|---|---|---|
| JP | 2007-047379 | 2/2007 |
| JP | 2007-140189 | 6/2007 |
| JP | 2008-009005 | 1/2008 |
| JP | 2009-031759 | 2/2009 |
| JP | 2009-116298 | 5/2009 |
| JP | 2011-164389 | 8/2011 |

* cited by examiner

*Primary Examiner* — Ryan Walsh
*Assistant Examiner* — Philip Marcus T Fadul
(74) *Attorney, Agent, or Firm* — Harness, Dickey & Pierce, P.L.C.

(57) ABSTRACT

A fixing device includes a separator disposed downstream from a fixing nip formed between a fixing rotary body and a pressing rotary body in a recording medium conveyance direction to separate a recording medium from the fixing rotary body. The separator includes a front disposed opposite an outer circumferential surface of the fixing rotary body with a given interval therebetween and a conveyance face contiguous to the front, over which the recording medium slides. A coating layer, made of fluoroplastic, coats the front and the conveyance face of the separator. The coating layer includes a front portion corresponding to the front of the separator and produced with a plurality of recesses extending in a width direction of the separator orthogonal to the recording medium conveyance direction throughout substantially an entire width of the separator in the width direction thereof.

19 Claims, 6 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2012-129279, filed on Jun. 6, 2012, in the Japanese Patent Office, the entire disclosure of which is hereby incorporated by reference herein.

BACKGROUND OF THE INVENTION

1. Field of the Invention

Example embodiments generally relate to a fixing device and an image forming apparatus, and more particularly, to a fixing device for fixing an image on a recording medium and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing roller and a pressing roller pressed against the fixing roller to form a fixing nip therebetween through which the recording medium bearing the toner image passes. As the fixing roller heated by a heater and the pressing roller rotate and convey the recording medium through the fixing nip, they apply heat and pressure to the recording medium, thus fixing the toner image on the recording medium.

After being discharged from the fixing nip, the recording medium separates from the fixing roller by its rigidity. However, if the recording medium is thin and soft, it may not separate from the fixing roller readily and therefore may be wound around the fixing roller. To address this circumstance, a separator may be disposed downstream from the fixing nip in a recording medium conveyance direction to contact and separate the recording medium from the fixing roller.

However, if the thin, soft recording medium bears a solid toner image, the solid toner image, immediately after being discharged from the fixing nip, may not be cooled sufficiently and therefore molten toner of the solid toner image may adhere the recording medium to the separator. To address this circumstance, the separator may be coated with a fluoroplastic layer that facilitates separation of the solid toner image on the thin, soft recording medium from the separator.

However, as the thin, soft recording medium bearing the solid toner image slides over the fluoroplastic layer coating the separator, the solid toner image may be caught in the fluoroplastic layer and therefore the thin, soft recording medium may be tucked. As the solid toner image is caught in the fluoroplastic layer repeatedly, the solid toner image on the tucked recording medium may be deformed into a caterpillar pattern. For example, a section of the solid toner image caught and adhered to the fluoroplastic layer may be damaged while another section of the solid toner image not adhered to the fluoroplastic layer may be clean. Thus, the damaged section and the clean section of the solid toner image, as they are repeatedly produced, may form a faulty caterpillar pattern on the shin, soft recording medium.

SUMMARY OF THE INVENTION

At least one embodiment may provide a fixing device that includes a fixing rotary body rotatable in a given direction of rotation. A pressing rotary body is pressed against the fixing rotary body to form a fixing nip therebetween through which a recording medium is conveyed. A separator is disposed downstream from the fixing nip in a recording medium conveyance direction to separate the recording medium discharged from the fixing nip from the fixing rotary body. The separator includes a front disposed opposite an outer circumferential surface of the fixing rotary body with a given interval therebetween and a conveyance face contiguous to the front, over which the recording medium slides. A coating layer, made of fluoroplastic, coats the front and the conveyance face of the separator. The coating layer includes a front portion corresponding to the front of the separator and produced with a plurality of recesses extending in a width direction of the separator orthogonal to the recording medium conveyance direction throughout substantially an entire width of the separator in the width direction thereof.

At least one embodiment may provide an image forming apparatus including the fixing device described above.

Additional features and advantages of example embodiments will be more fully apparent from the following detailed description, the accompanying drawings, and the associated claims.

BRIEF DESCRIPTION OF THE SEVERAL VIEWS OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
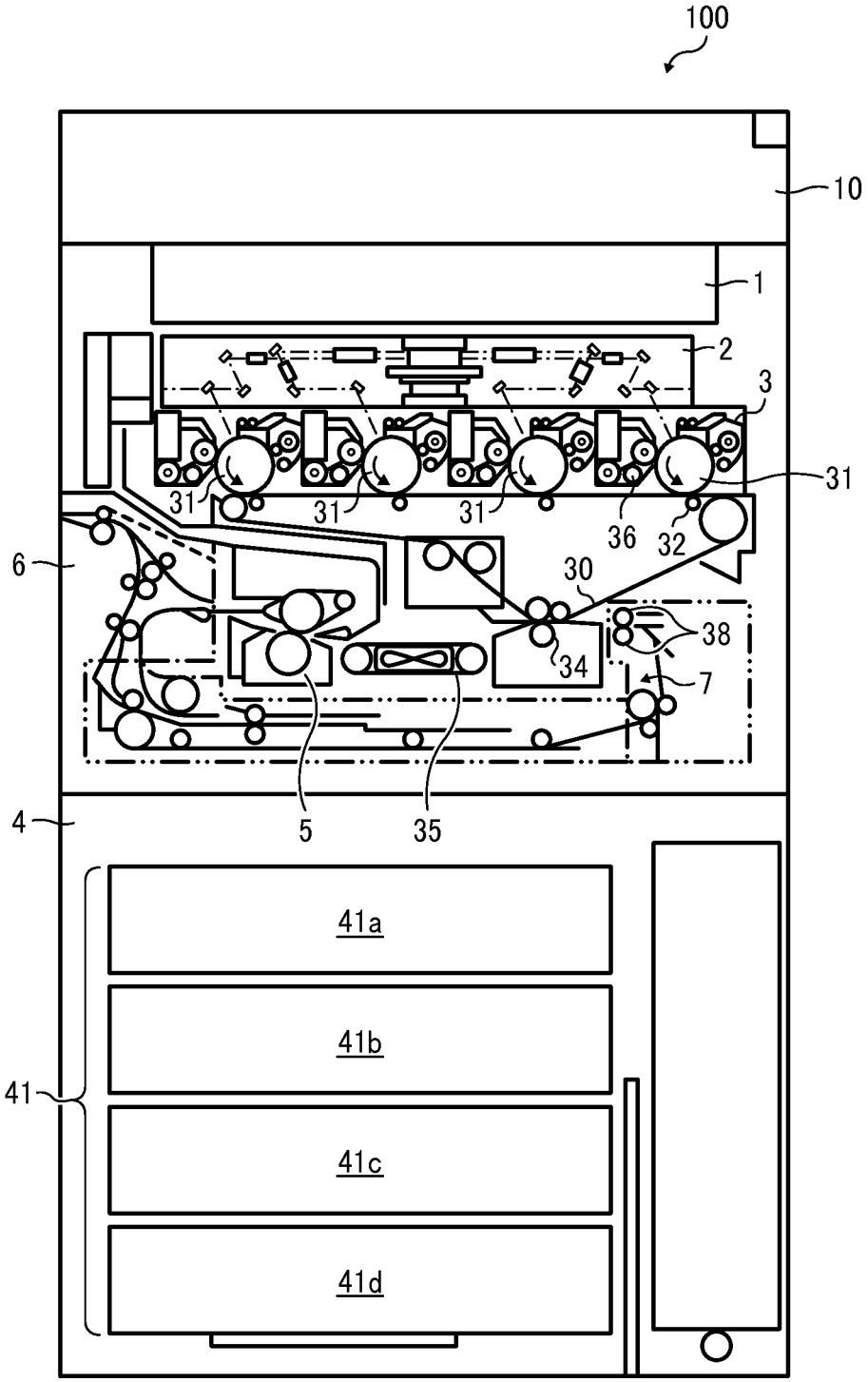
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

FIG. 1 is a schematic vertical sectional view of the image forming apparatus 100. The image forming apparatus 100 may be a copier, a facsimile machine, a printer, a multifunction printer (MFP) having at least one of copying, printing, scanning, plotter, and facsimile functions, or the like. According to this example embodiment, the image forming apparatus 100 is a digital color copier that forms color and monochrome toner images on recording media by electrophotography.

As shown in FIG. 1, the image forming apparatus 100 includes a scanner 1 located in an upper portion of the image forming apparatus 100 to optically read an image on an original conveyed from an auto document feeder (ADF) 10 situated above the scanner 1 into color image data. The ADF 10 loads and feeds a plurality of originals continuously to the scanner 1. Below the scanner 1 is a writer 2 for emitting light that optically scans four photoconductive drums 31.

For example, the writer 2 emits light onto the uniformly charged, four photoconductive drums 31 according to respective black, magenta, yellow, and cyan image data constituting the color image data created by and sent from the scanner 1 or color image data sent from an external device such as a client computer, thus forming electrostatic latent images on the photoconductive drums 31, respectively.

Taking one of the four photoconductive drums 31 that forms a black toner image, for example, a development device 3 visualizes the electrostatic latent image formed on the photoconductive drum 31 into a black toner image. The black toner image formed on the photoconductive drum 31 is primarily transferred onto an intermediate transfer belt 30 by a primary transfer roller 32 disposed opposite the photoconductive drum 31 via the intermediate transfer belt 30. Similarly, other three development devices 3 visualize the electrostatic latent images formed on the corresponding photoconductive drums 31 into magenta, yellow, and cyan toner images that are primarily transferred onto the intermediate transfer belt 30. Thus, the black, magenta, yellow, and cyan toner images are primarily transferred and superimposed onto a same position on the intermediate transfer belt 30, forming a color toner image thereon. After the primary transfer of the black toner image, a cleaner 36 removes residual black toner failed to be transferred onto the intermediate transfer belt 30 and therefore remaining on the photoconductive drum 31 therefrom. Similarly, residual magenta, yellow, and cyan toners remaining on the other three photoconductive drums 31 are removed therefrom.

A sheet feeder 4 is located in a lower portion of the image forming apparatus 100. The sheet feeder 4 includes a paper tray set 41 constructed of four paper trays 41*a*, 41*b*, 41*c*, and 41*d* that load recording media (e.g., sheets). A recording medium is picked up and conveyed from one of the four paper trays 41*a*, 41*b*, 41*c*, and 41*d* toward a registration roller pair 38 through a conveyance path 7 extending from the paper trays 41*a*, 41*b*, 41*c*, and 41*d* to the registration roller pair 38. After skew correction, the registration roller pair 38 directs and feeds the recording medium to a secondary transfer device 34 contacting the intermediate transfer belt 30 so that the recording medium reaches the secondary transfer device 34 at a time when the color toner image formed on the intermediate transfer belt 30 reaches the secondary transfer device 34. Thus, the secondary transfer device 34 secondarily transfers the color toner image formed on the intermediate transfer belt 30 onto the recording medium.

Downstream from the secondary transfer device 34 in a recording medium conveyance direction is a fixing device 5 that fixes the color toner image on the recording medium. For example, after passing through the secondary transfer device 34, the recording medium bearing the color toner image is conveyed to the fixing device 5 through a conveyance belt 35 interposed between the secondary transfer device 34 and the fixing device 5 in the recording medium conveyance direction. The fixing device 5 applies heat and pressure to the recording medium, thus fixing the color toner image on the recording medium. Thereafter, the recording medium bearing the fixed color toner image is discharged from the image forming apparatus 100 through an outlet 6. Thus, a series of image forming processes to form the color toner image on the recording medium is completed.

Figure 2:
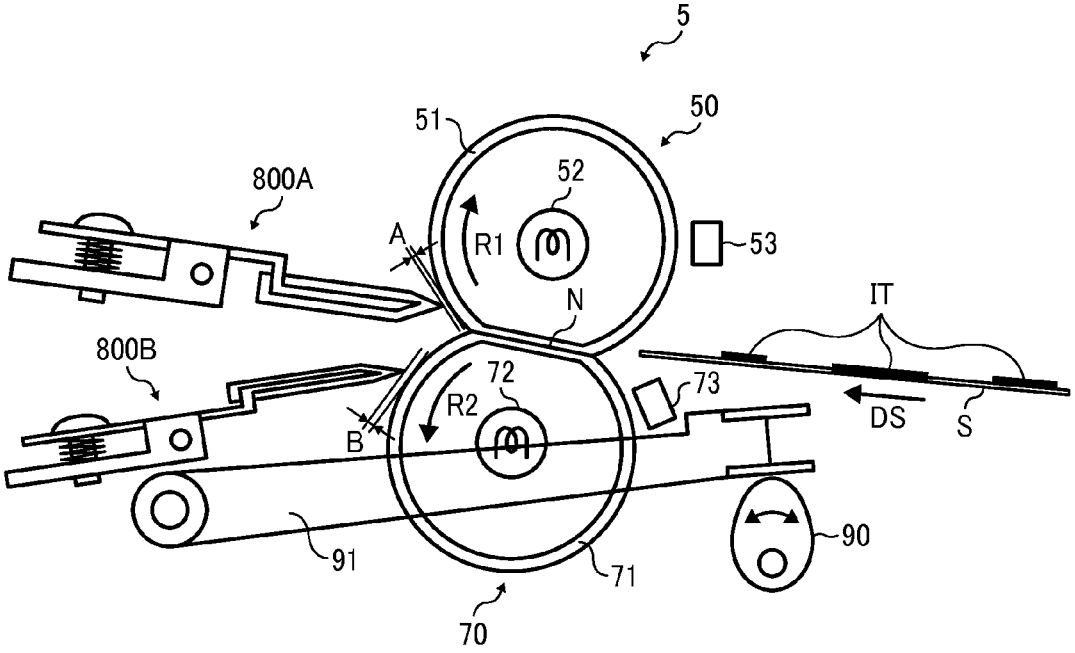
FIG. 2 is a vertical sectional view of a fixing device according to a first example embodiment of the present invention that is installed in the image forming apparatus shown in FIG. 1.

With reference to FIG. 2, a description is provided of a construction of the fixing device 5 according to a first example embodiment that is incorporated in the image forming apparatus 100 described above.

FIG. 2 is a vertical sectional view of the fixing device 5. As shown in FIG. 2, the fixing device 5 (e.g., a fuser) includes a fixing assembly 50 and a pressing assembly 70 pressed against the fixing assembly 50 to form a fixing nip N therebetween through which a recording medium S bearing a toner image IT is conveyed. As the recording medium S is conveyed through the fixing nip N, the fixing assembly 50 and the pressing assembly 70 apply heat and pressure to the recording medium S to fix the toner image IT on the recording medium S.

A detailed description is now given of a construction of the fixing assembly 50.

The fixing assembly 50 includes a hollow fixing roller 51 serving as a fixing rotary body rotatable in a rotation direction R1 and a heater 52 (e.g., a heat source) disposed inside and heating the fixing roller 51. The fixing roller 51 is constructed of a metal core, an elastic layer coating the metal core and made of silicone rubber, and a surface release layer coating the elastic layer and made of fluoroplastic.

A detailed description is now given of a construction of the pressing assembly 70.

The pressing assembly 70 includes a hollow pressing roller 71 serving as a pressing rotary body rotatable in a rotation direction R2 counter to the rotation direction R1 of the fixing roller 51 and a heater 72 disposed inside and heating the pressing roller 71. The pressing roller 71 is constructed of a metal core, an elastic layer coating the metal core and made of rubber, and a surface release layer coating the elastic layer and made of fluoroplastic.

A temperature sensor 53 is disposed opposite an outer circumferential surface of the fixing roller 51 to detect the temperature of the fixing roller 51. Similarly, a temperature sensor 73 is disposed opposite an outer circumferential surface of the pressing roller 71 to detect the temperature of the pressing roller 71. A controller (e.g., a processor), that is, a central processing unit (CPU) provided with a random-access memory (RAM) and a read-only memory (ROM), for example, is operatively connected to the heaters 52 and 72 and the temperature sensors 53 and 73. The controller controls the heaters 52 and 72 based on the temperature of the fixing roller 51 detected by the temperature sensor 53 and the temperature of the pressing roller 71 detected by the temperature sensor 73 so as to adjust the temperature of each of the fixing roller 51 and the pressing roller 71 to a desired fixing temperature. For example, the temperature sensor 53 includes a plurality of sensors disposed opposite a center and a lateral end of the fixing roller 51 in a longitudinal direction or an axial direction thereof to detect the temperature of the center and the lateral end of the fixing roller 51.

The pressing roller 71 is contacted by a lever 91 that is swingable as it is lifted or lowered by a cam 90 rotatably contacting the lever 91. As the cam 90 lifts the lever 91, the lever 91 presses the pressing roller 71 against the fixing roller 51, forming the fixing nip N between the pressing roller 71 and the fixing roller 51 by elastic deformation of the elastic layers of the pressing roller 71 and the fixing roller 51 caused by pressure from the pressing roller 71.

As the recording medium S bearing the toner image IT is conveyed through the fixing nip N while sandwiched between the fixing roller 51 rotating in the rotation direction R1 and the pressing roller 71 rotating in the rotation direction R2, the recording medium S receives heat and pressure from the fixing roller 51 and the pressing roller 71 that melt and fix the toner image IT on the recording medium S. When the recording medium S bearing the fixed toner image IT is discharged from the fixing nip N, it is separated from the fixing roller 51 and conveyed in a recording medium conveyance direction DS.

Immediately after the recording medium S is discharged from the fixing nip N, the toner image IT melted while the recording medium S passes through the fixing nip N is not cooled and solidified. Hence, the recording medium S adheres to the outer circumferential surface of the fixing roller 51 by an adhesive force of molten toner of the toner image IT.

If the recording medium S is rigid enough to overcome the adhesive force of the molten toner, the recording medium S separates from the fixing roller 51. Conversely, if the recording medium S is thin paper that is not rigid enough to overcome the adhesive force of the molten toner or if the toner image IT is a relatively large, solid toner image that has a greater adhesive force, the recording medium S does not have a separation force great enough to separate itself from the fixing roller 51. Accordingly, the recording medium S may not separate from the fixing roller 51 and may be wound around the fixing roller 51. To address this circumstance, a separation assembly 800A and a guide assembly 800B are disposed downstream from the fixing nip N in the recording medium conveyance direction DS.

Figure 3:
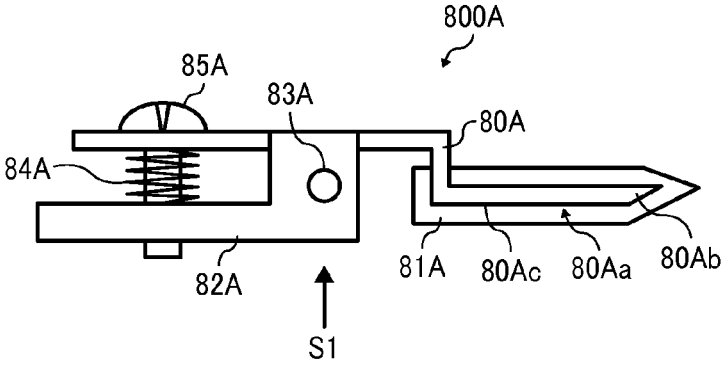
FIG. 3 is a vertical sectional view of a separation assembly incorporated in the fixing device shown in FIG. 2.

With reference to FIG. 3, a description is provided of a construction of the separation assembly 800A.

FIG. 3 is a vertical sectional view of the separation assembly 800A. As shown in FIG. 3, the separation assembly 800A includes a bracket 82A and a separator 80A rotatably or swingably attached to the bracket 82A. The separator 80A includes a base 80Aa disposed opposite the fixing roller 51 and made of heat-resistant, rigid resin such as polyether ether ketone (PEEK), polyether ketone (PEK), liquid crystal polymer (LCP), polyphenylene sulfide (PPS) or metal such as aluminum. The base 80Aa is coated with a coating layer 81A made of fluoroplastic.

The base 80Aa includes a front 80Ab disposed opposite the fixing roller 51 with a given slight interval A depicted in FIG. 2 therebetween and a conveyance face 80Ac, contiguous to and disposed downstream from the front 80Ab in the recording medium conveyance direction DS. The recording medium S conveyed between the separation assembly 800A and the guide assembly 800B slides over the conveyance face 80Ac of the base 80Aa.

According to this example embodiment shown in FIG. 3, the coating layer 81A coats the entire base 80Aa of the separator 80A. Alternatively, at least the front 80Ab and the conveyance face 80Ac of the base 80Aa that contact the recording medium S conveyed between the separation assembly 800A and the guide assembly 800B may be made of or coated with fluoroplastic.

The coating layer 81A has a smooth surface. Fluoroplastic of the coating layer 81A may be made of heat-resistant resin that facilitates separation of the toner image IT on the recording medium S from the coating layer 81A, such as tetrafluoroethylene-perfluoroalkyl vinyl ether copolymer (PFA), tetrafluoroethylene-hexafluoropropylene copolymer (FEP), tetrafluoroethylene ethylene copolymer (ETFE), vinylidene fluoride resin (PVDF), vinyl fluoride resin (PVF), and ethylene-chlorotrifluoroethylene resin (ECTFE).

The separator 80A is supported by the bracket 82A serving as a support such that the separator 80A is pivotable about a pin 83A attached to the bracket 82A. The separator 80A is fastened to the bracket 82A with a screw 85A through a compression spring 84A anchored to the bracket 82A and the separator 80A.

By adjusting the screw 85A, the separator 80A is swingably positioned with respect to the fixing roller 51 such that the slight interval A of about 0.2 mm, for example, is produced between the front 80Ab of the separator 80A and the outer circumferential surface of the fixing roller 51 as shown in FIG. 2.

A part of the smooth surface of the coating layer 81A corresponding to the front 80Ab of the separator 80A is produced with a plurality of recesses extending in a width direction of the separator 80A orthogonal to the recording medium conveyance direction DS throughout substantially the entire width of the separator 80A in the width direction thereof.

Figure 4:
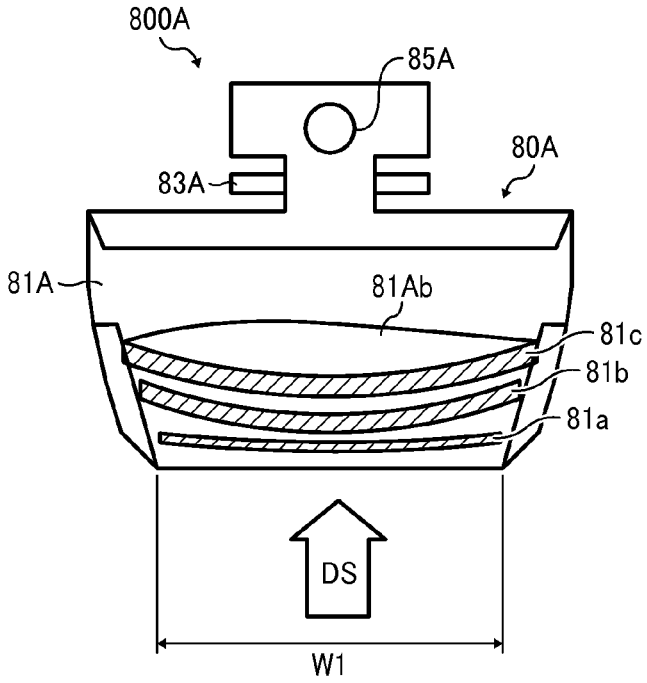
FIG. 4 is a plan view of a separator incorporated in the separation assembly shown in FIG. 3.
Figure 5:
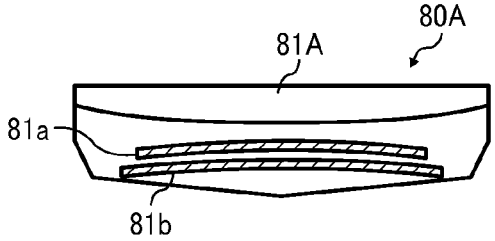
FIG. 5 is a partial plan view of the separator shown in FIG. 4 illustrating recesses mounted thereon.

With reference to FIGS. 4 and 5, a detailed description is now given of a construction of the separator 80A.

FIG. 4 is a plan view of the separator 80A seen from a direction S1 depicted in FIG. 3. As shown in FIG. 4, three recesses 81*a*, 81*b*, and 81*c* are produced in a front portion 81Ab constituting the smooth surface of the coating layer 81A that corresponds to the front 80Ab of the separator 80A. The recesses 81*a*, 81*b*, and 81*c* extend in a width direction W1 of the separator 80A that is orthogonal to the recording medium conveyance direction DS and parallel to the axial direction of the fixing roller 51 throughout substantially the entire width of the separator 80A in the width direction W1 thereof.

FIG. 5 is a partial plan view of the separator 80A illustrating the recesses 81*a* and 81*b* disposed in proximity to the fixing nip N. It is to be noted that the recess 81*c* is omitted in FIG. 5.

If the recording medium S is rigid enough to separate from the fixing roller 51, the recording medium S separates from the fixing roller 51 by its rigidity and is conveyed along the conveyance face 80Ac of the separator 80A. Contrarily, if the recording medium S is thin and soft, the recording medium S may not separate from the fixing roller 51 by its rigidity and therefore may require the separator 80A that facilitates separation of the recording medium S from the fixing roller 51. That is, the thinner and softer the recording medium S is, more difficult it is for the recording medium S to separate from the fixing roller 51 by its rigidity.

For example, as the recording medium S is thinner and softer, the recording medium S separates from the fixing roller 51 at the position closer to the front 80Ab of the separator 80A. Accordingly, as the recording medium S separates from the fixing roller 51 at the position in proximity to the front 80Ab of the separator 80A, the recording medium S slides over the front portion 81Ab of the coating layer 81A corresponding to the front 80Ab of the separator 80A.

For example, if a plurality of projections and recesses is produced in the coating layer 81A, when a thin, smooth, glossy sheet bearing a solid toner image IT is used as a recording medium S, the solid toner image IT may slide over the projections of the coating layer 81A with increased friction therebetween, producing acute streaks on the solid toner image IT. To address this circumstance, according to this example embodiment, the smooth surface of the coating layer 81A coating the separator 80A does not have partial, slight asperities, that is, projections and recesses. Accordingly, even if the solid toner image IT slides over the coating layer 81A, the coating layer 81A does not produce acute streaks on the solid toner image IT.

The front portion 81Ab of the coating layer 81A coating the front 80Ab of the separator 80A is produced with the plurality of recesses 81*a*, 81*b*, and 81*c*. Accordingly, even if the solid toner image IT on the thin recording medium S slides over the coating layer 81A coating the separator 80A in a substantial slide area thereof in the recording medium conveyance direction DS, the plurality of recesses 81*a*, 81*b*, and 81*c* decreases the slide area without obstructing conveyance of the recording medium S, thus preventing formation of a caterpillar pattern on the solid toner image IT effectively.

Further, if a plurality of ribs extending in a slanting direction relative to the recording medium conveyance direction DS is mounted on the separator 80A, when a sheet bearing a relatively small toner image or a rigid sheet is used as a recording medium S, the toner image may slide over a part of the separator 80A, that is, the ribs, with increased friction therebetween. Accordingly, a section of the toner image that slides over the ribs may have decreased gloss while another section of the toner image that does not slide over the ribs may have increased gloss, resulting in variation in gloss of the toner image regularly produced in the recording medium conveyance direction DS. To address this circumstance, according to this example embodiment, even if the recording medium S slides over a part of the separator 80A via the coating layer 81A, the plurality of recesses 81*a*, 81*b*, and 81*c* produces slide faces between the adjacent recesses 81*a*, 81*b*, and 81*c* that extend substantially evenly in the width direction W1 of the separator 80A orthogonal to the recording medium conveyance direction DS, thus preventing variation in gloss of the toner image IT regularly produced in the recording medium conveyance direction DS.

With reference to FIG. 2, a detailed description is now given of a construction of the guide assembly 800B.

If there is no possibility that the recording medium S is wound around the pressing roller 71, it is not necessary for the guide assembly 800B to have a construction described below with reference to FIG. 6. In this case, the guide assembly 800B serves as a guide that contacts and guides a back side of the recording medium S discharged from the fixing nip N that faces the guide assembly 800B to the outside of the fixing device 5. That is, the guide assembly 800B serves as a conveyance path producer that produces a conveyance path extending from the fixing nip N to the outside of the fixing device 5, through which the recording medium S discharged from the fixing nip N is conveyed.

The recording medium S may be wound around the pressing roller 71 when the image forming apparatus 100 depicted in FIG. 1 performs duplex printing. For example, as a recording medium S bearing a fixed toner image IT on a front side thereof and an unfixed toner image IT on a back side thereof is conveyed through the fixing nip N, the fixed toner image IT on the front side of the recording medium S that contacts the pressing roller 71 may be heated and melted by the pressing roller 71 heated by the heater 72, generating an adhesive force that adheres the fixed toner image IT to the pressing roller 71. Thus, the recording medium S may be wound around the pressing roller 71.

This problem may also arise when a used recording medium bearing a fixed toner image on the front side thereof is used for saving resources. To address this circumstance, the guide assembly 800B has a construction similar to that of the separation assembly 800A to facilitate separation of the recording medium S from the pressing roller 71 as shown in FIG. 6.

Figure 6:
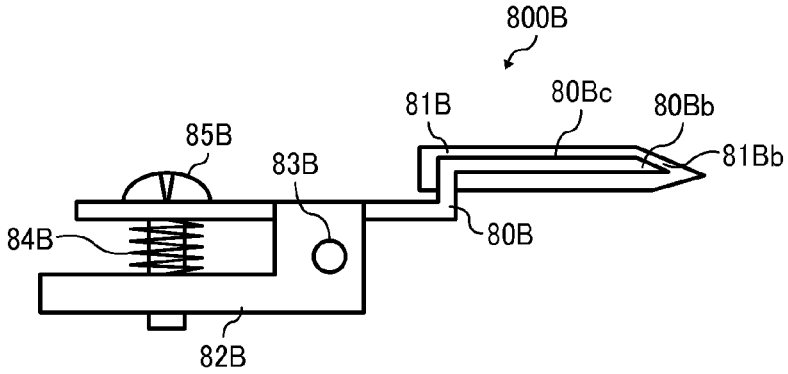
FIG. 6 is a vertical sectional view of a guide assembly incorporated in the fixing device shown in FIG. 2.

FIG. 6 is a vertical sectional view of the guide assembly 800B. As shown in FIG. 6, similarly to the separation assembly 800A depicted in FIG. 3, the guide assembly 800B, serving as a separation assembly that separates the recording medium S from the pressing roller 71 as well as a guide assembly that guides the recording medium S, includes a bracket 82B and a separator 80B rotatably or swingably attached to the bracket 82B. The separator 80B is supported by the bracket 82B such that the separator 80B is pivotable about a pin 83B. The separator 80B is fastened to the bracket 82B by a screw 85B through a compression spring 84B.

By adjusting the screw 85B, the separator 80B is swingably positioned with respect to the pressing roller 71 such that a given slight interval B of about 0.2 mm, for example, is produced between a front 80Bb of the separator 80B and the outer circumferential surface of the pressing roller 71 as shown in FIG. 2.

Similarly to the separator 80A depicted in FIG. 3, the front 80Bb of the separator 80B disposed opposite the pressing roller 71 is coated with a coating layer 81B made of fluoroplastic. A front portion 81Bb of the smooth surface of the coating layer 81B corresponding to the front 80Bb of the separator 80B over which the recording medium S slides is produced with the plurality of recesses 81*a*, 81*b*, and 81*c* extending in a width direction of the separator 80B parallel to an axial direction of the pressing roller 71 and orthogonal to the recording medium conveyance direction DS throughout substantially the entire width of the separator 80B in the width direction thereof.

Figure 7:
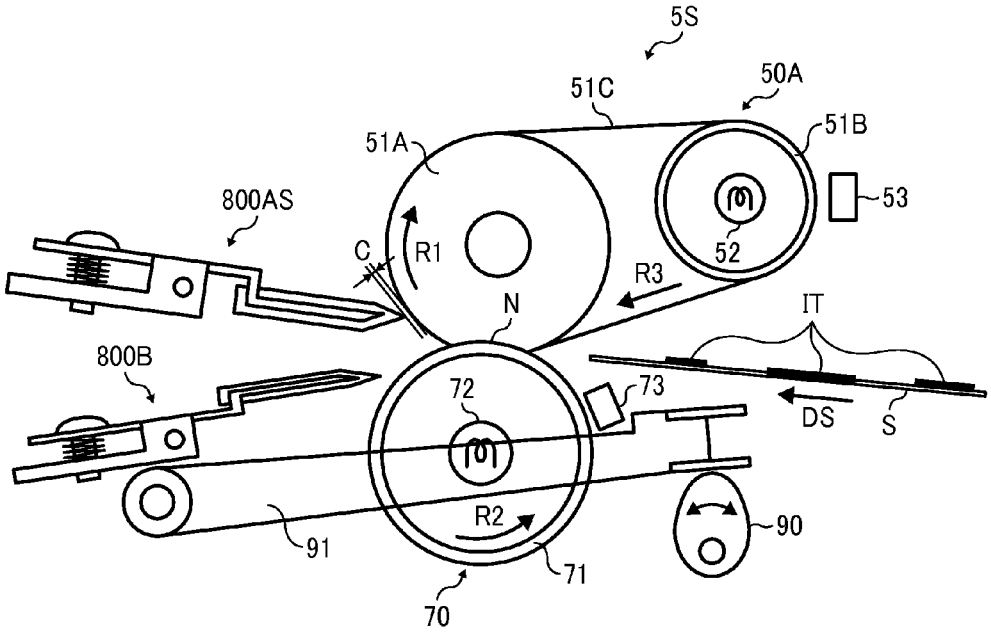
FIG. 7 is a vertical sectional view of a fixing device according to a second example embodiment of the present invention that is installable in the image forming apparatus shown in FIG. 1.

With reference to FIG. 7, a description is provided of a construction of a fixing device 5S according to a second example embodiment.

FIG. 7 is a vertical sectional view of the fixing device 5S. Unlike the fixing device 5 depicted in FIG. 2, the fixing device 5S depicted in FIG. 7 includes a fixing assembly 50A instead of the fixing assembly 50. As shown in FIG. 7, the fixing assembly 50A includes an endless fixing belt 51C; a fixing roller 51A and a heating roller 51B across which the fixing belt 51C is stretched; and a heater 52 disposed inside the heating roller 51B to heat the fixing belt 51C via the heating roller 51B.

As the cam 90 lifts the lever 91, the lever 91 presses the pressing roller 71 against the fixing roller 51A via the fixing belt 51C to form the fixing nip N between the pressing roller 71 and the fixing belt 51C. The fixing roller 51A rotating in the rotation direction R1 rotates the fixing belt 51C in a rotation direction R3. As the fixing belt 51C rotating in the rotation direction R3 and the pressing roller 71 rotating in the rotation direction R2 convey a recording medium S bearing a toner image IT through the fixing nip N, the fixing belt 51C and the pressing roller 71 apply heat and pressure to the recording medium S, fixing the toner image IT on the recording medium S. The temperature sensor 53 includes a plurality of sensors disposed opposite an outer circumferential surface of the fixing belt 51C at a center and a lateral end of the fixing belt 51C in an axial direction thereof, thus detecting the temperature of the center and the lateral end of the fixing belt 51C.

In order to facilitate separation of the recording medium S from the fixing belt 51C, a hardness of the fixing roller 51A is smaller than that of the pressing roller 71. Thus, the harder pressing roller 71 presses against the softer fixing roller 51A to contour the fixing nip N to fit into a curve of the pressing roller 71. Accordingly, the curve of the pressing roller 71 directs the recording medium S discharged from the fixing nip N downward toward the pressing roller 71. Consequently, the recording medium S does not adhere to the fixing belt 51C.

The smaller hardness of the fixing roller 51A increases the coefficient of thermal expansion of the fixing roller 51A. Hence, as the temperature of the fixing roller 51A fluctuates, the diameter of the fixing roller 51A is subject to change. Accordingly, although a given slight interval C is produced between the front 80Ab of a separation assembly 800AS and the outer circumferential surface of the fixing belt 51C, the slight interval C may change as the fixing roller 51A thermally expands. To address this circumstance, the fixing device 5S has a configuration that reduces change of the slight interval C as below.

Figure 8:
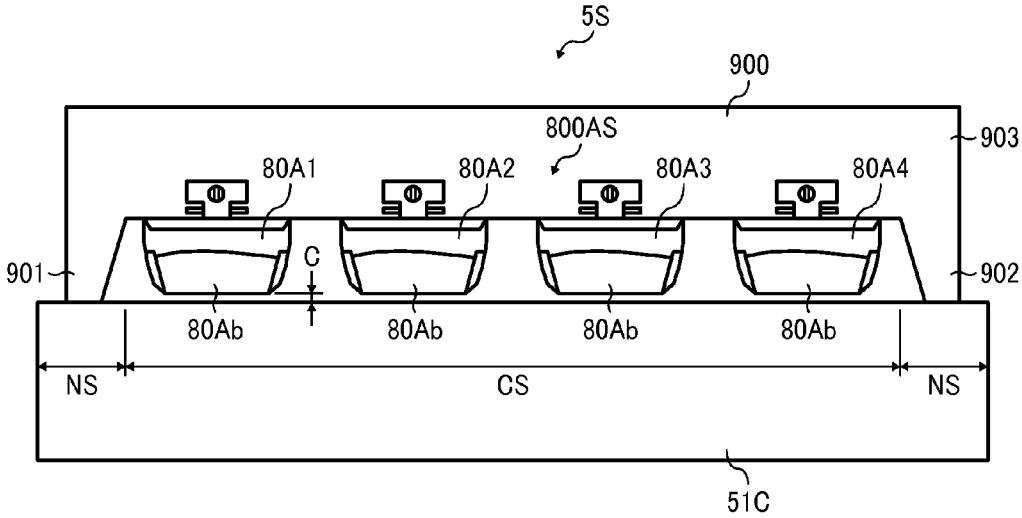
FIG. 8 is a partial plan view of the fixing device shown in FIG. 7 illustrating separators and a support incorporated therein.

FIG. 8 is a partial plan view of the fixing device 5S illustrating a part of the fixing belt 51C that contacts the fixing roller 51A. A recording medium conveyance span CS defines a span spanning in the axial direction of the fixing belt 51C on the outer circumferential surface thereof where the recording medium S is conveyed. That is, the recording medium conveyance span CS corresponds to a width of the recording medium S in the axial direction of the fixing belt 51C. The fixing device 5S includes a bracket 900 serving as a support that supports the separation assembly 800AS including a plurality of separators, that is, four separators 80A1, 80A2, 80A3, and 80A4. The four separators 80A1, 80A2, 80A3, and 80A4 are attached to and supported by the bracket 900.

Each of the four separators 80A1, 80A2, 80A3, and 80A4 has a configuration similar to that of the separator 80A shown in FIG. 3 and is attached to the bracket 900 with the mechanism shown in FIG. 3, that includes the pin 83A, the spring 84A, and the screw 85A. However, the bracket 900 has a configuration different from that of the bracket 82A shown in FIG. 3.

With reference to FIG. 8, a detailed description is now given of a configuration of the bracket 900.

The bracket 900 is constructed of a body 903 disposed opposite the fixing belt 51C and two arms 901 and 902 projecting from the body 903 at both lateral ends of the body 903 in the axial direction of the fixing belt 51C toward the fixing belt 51C. The arms 901 and 902 contact the fixing belt 51C in non-conveyance spans NS on the outer circumferential surface of the fixing belt 51C that are disposed outboard from the conveyance span CS in the axial direction of the fixing belt 51C. The recording medium S is not conveyed in the non-conveyance spans NS. As the fixing roller 51A thermally expands, the bracket 900 having the arms 901 and 902 in contact with the fixing belt 51C moves in accordance with thermal expansion of the fixing roller 51A. Accordingly, the slight interval C is retained constantly between the front 80Ab of the respective separators 80A1, 80A2, 80A3, and 80A4 and the outer circumferential surface of the fixing belt 51C. Consequently, even if the fixing roller 51A thermally expands, the separators 80A1, 80A2, 80A3, and 80A4 maintain their performance of separating the recording medium S from the fixing belt 51C.

Additionally, since the bracket 900 retains the constant slight interval C between the separators 80A1, 80A2, 80A3, and 80A4 and the fixing belt 51C, the recording medium S slides over the separators 80A1, 80A2, 80A3, and 80A4 with a constant friction, reducing variation in gloss of the toner image IT caused by friction between the recording medium S and the separators 80A1, 80A2, 80A3, and 80A4. Further, acute streaks, a caterpillar pattern, and variation in gloss of the toner image IT regularly produced in the recording medium conveyance direction DS are suppressed effectively.

According to this example embodiment, the bracket 900 supports the four separators 80A1, 80A2, 80A3, and 80A4 as one example. Alternatively, the number of separators supported by the bracket 900 may be three or less or five or more. Yet alternatively, the bracket 900 may be employed by the fixing device 5 depicted in FIG. 2 instead of the bracket 82A depicted in FIG. 3.

Each of the separators 80A1, 80A2, 80A3, and 80A4 has a configuration similar to that of the separator 80A depicted in FIGS. 3 to 5. That is, each of the separators 80A1, 80A2, 80A3, and 80A4 mounts the recesses 81*a*, 81*b*, and 81*c* shaped and positioned as shown in FIGS. 4 and 5.

As shown in FIG. 4, the three recesses 81*a*, 81*b*, and 81*c* are produced in the coating layer 81A. The recesses 81*a*, 81*b*, and 81*c* are curved to project downward in FIG. 4. For example, the recesses 81*a*, 81*b*, and 81*c* are curved to project toward an edge of the separator 80A that is disposed opposite the fixing roller 51 depicted in FIG. 2 or the fixing belt 51C depicted in FIG. 7 or toward the fixing nip N from which the recording medium S is conveyed in the recording medium conveyance direction DS to the separator 80A. It is because, if the recesses 81*a*, 81*b*, and 81*c* are straight along the width direction W1 of the separator 80A orthogonal to the recording medium conveyance direction DS, a step height of the respective recesses 81*a*, 81*b*, and 81*c* may impose load to the recording medium S sliding over the separator 80A, degrading conveyance of the recording medium S separated from the fixing roller 51 by the separator 80A. To address this circumstance, the recesses 81*a*, 81*b*, and 81*c* are curved to project toward the fixing nip N so that a leading edge of the recording medium S is not stuck in steps of the recesses 81*a*, 81*b*, and 81*c* simultaneously throughout a longitudinal direction of the recesses 81*a*, 81*b*, and 81*c* parallel to the axial direction of the fixing roller 51, thus facilitating conveyance of the recording medium S.

Figure 9:
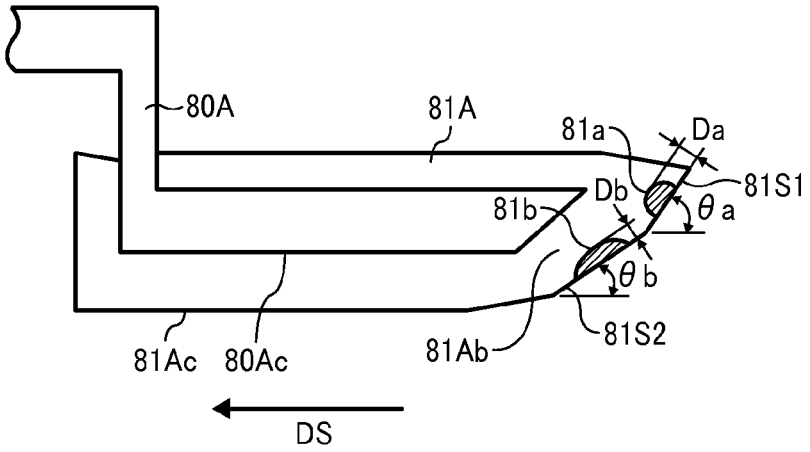
FIG. 9 is a partial vertical sectional view of the separator shown in FIG. 4.

With reference to FIG. 9, a description is provided of the shape of the recesses 81*a*, 81*b*, and 81*c*.

FIG. 9 is a partial vertical sectional view of the separator 80A. As shown in FIG. 9, as seen in a direction orthogonal to the recording medium conveyance direction DS, the recesses 81*a* and 81*b* produced in the coating layer 81A are arc-shaped in cross-section.

A first angle θa is formed between a first slope 81S1 of the coating layer 81A, corresponding to a front edge of the separator 80A, and a conveyance face 81Ac of the coating layer 81A, over which the recording medium S slides, in cross-section. A second angle θb is formed between a second slope 81S2 of the coating layer 81A, contiguous to and disposed downstream from the first slope 81S1 in the recording medium conveyance direction DS, and the conveyance face 81Ac, in cross-section. The first angle θa closer to the fixing roller 51 than the second angle θb is greater than the second angle θb.

Figure 10:
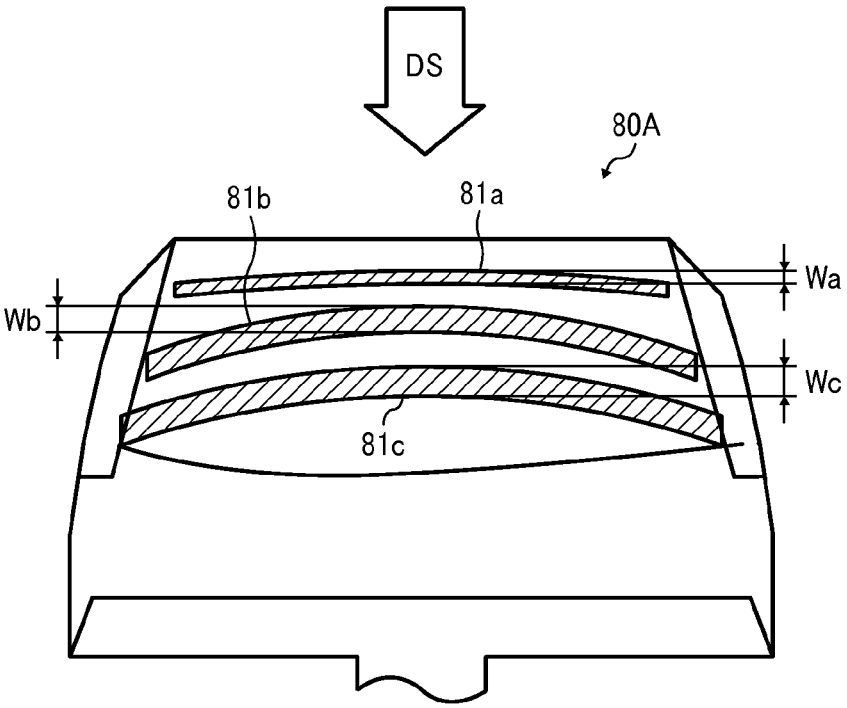
FIG. 10 is a partial plan view of the separator shown in FIG. 9.

With reference to FIG. 10, a description is provided of the length of the respective recesses 81*a*, 81*b*, and 81*c* in the recording medium conveyance direction DS.

FIG. 10 is a partial plan view of the separator 80A. As shown in FIG. 10, the greater the angle formed between the slope and the conveyance face 81Ac of the coating layer 81A is, the smaller the length of the recess in the recording medium conveyance direction DS produced in the slope is.

For example, since the first angle θa formed between the first slope 81S1 and the conveyance face 81Ac of the coating layer 81A is greater than the second angle θb formed between the second slope 81S2 and the conveyance face 81Ac of the coating layer 81A, a first length Wa of the recess 81*a* in the recording medium conveyance direction DS, that is, a first recess produced in the first slope 81S1 that forms the greater first angle θa with the conveyance face 81Ac, is smaller than a second length Wb of the recess 81*b* in the recording medium conveyance direction DS, that is, a second recess produced in the second slope 81S2 that forms the smaller second angle θb with the conveyance face 81Ac.

An adhesive force of the solid toner image IT on the recording medium S to adhere to the coating layer 81A is relatively small in proximity to the recess 81*a* produced in the first slope 81S1 that forms the greater first angle θa with the conveyance face 81Ac. Contrarily, an adhesive force of the solid toner image IT on the recording medium S to adhere to the coating layer 81A is relatively great in proximity to the recess 81*b* produced in the second slope 81S2 that forms the smaller second angle θb with the conveyance face 81Ac. To address this circumstance, the second length Wb of the recess 81*b* is greater than the first length Wa of the recess 81*a* in the recording medium conveyance direction DS to decrease the area of the slide surface of the coating layer 81A over which the recording medium S slides, thus decreasing the adhesive force of the solid toner image IT on the recording medium S to adhere to the coating layer 81A. Accordingly, the adhesive force of the solid toner image IT to adhere to the coating layer 81A is constant regardless of variation of the first angle θa and the second angle θb, stably suppressing acute streaks, a caterpillar pattern, and variation in gloss of the toner image IT regularly produced in the recording medium conveyance direction DS.

FIG. 9 illustrates the two recesses 81*a* and 81*b*. Alternatively, the number of the recesses may be three or more. In this case also, as the angle formed between the slope and the conveyance face 81Ac of the coating layer 81A increases, the length of the recess in the recording medium conveyance direction DS produced in the slope decreases.

For example, FIG. 10 illustrates the three recesses 81*a*, 81*b*, and 81*c* and the length thereof in the recording medium conveyance direction DS. As shown in FIG. 10, the first length Wa of the recess 81*a* is smaller than the second length Wb of the recess 81*b* disposed downstream from the recess 81*a* in the recording medium conveyance direction DS. The second length Wb of the recess 81*b* is smaller than a third length Wc of the recess 81*c* disposed downstream from the recess 81*b* in the recording medium conveyance direction DS.

As shown in FIG. 9, a first depth Da of the recess 81*a* having the smaller first length Wa is greater than a second depth Db of the recess 81*b* having the greater second length Wb. As shown in FIG. 10, since the first length Wa of the recess 81*a* is smaller than the second length Wb of the recess 81*b* that is smaller than the third length Wc of the recess 81*c*, the first depth Da of the recess 81*a* is greater than the second depth Db of the recess 81*b* that is greater than a third depth Dc of the recess 81*c*.

If the second depth Db of the recess 81*b* having the greater second length Wb is greater than the first depth Da of the recess 81*a* having the smaller first length Wa, the leading edge of the recording medium S conveyed from the fixing nip N may be stuck in the deeper recess 81*b*. To address this problem, according to this example embodiment, the recess 81*b* having the greater second length Wb has the smaller second depth Db.

Figure 11A:
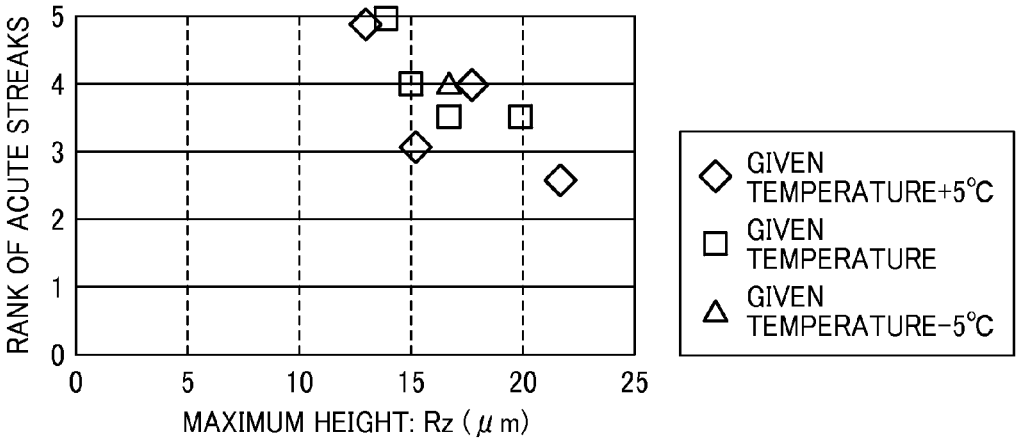
FIG. 11A is a graph showing a relation between the maximum height of a coating layer coating the separator shown in FIG. 9 and the rank of acute streaks that appear on a toner image on a recording medium sliding over the coating layer.
Figure 11B:
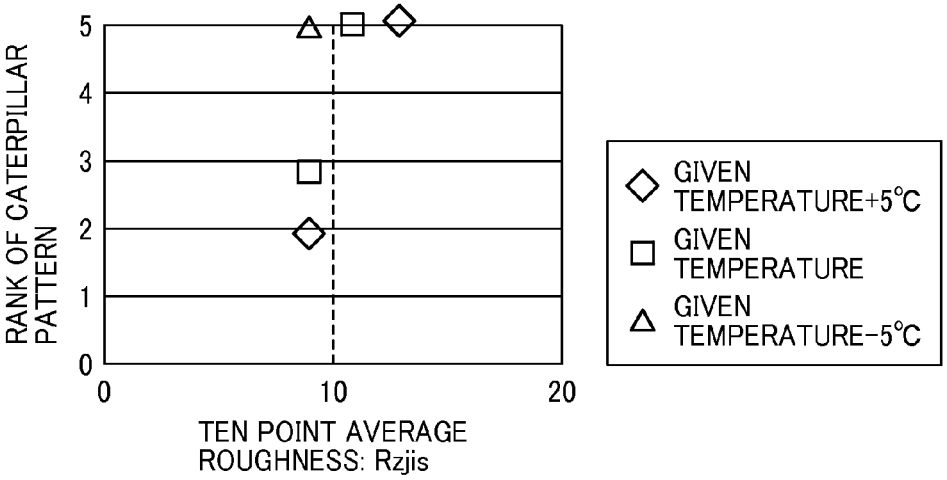
FIG. 11B is a graph showing a relation between the ten point average roughness Rzjis of a coating layer coating the separator shown in FIG. 9 and the rank of a caterpillar pattern that appears on a toner image on a recording medium sliding over the coating layer.

With reference to FIGS. 11A and 11B, a description is provided of results of an experiment to examine a relation between the roughness of the coating layer 81A coating the front 80Ab of the separator 80A and appearance of acute streaks and a caterpillar pattern on the toner image IT on the recording medium S caused by the separator 80A.

FIG. 11A is a graph showing a relation between the maximum height of the coating layer 81A and the rank of acute streaks that appear on the toner image IT on the recording medium S sliding over the coating layer 81A. The horizontal axis (x-axis) represents the maximum height Rz (μm) of the coating layer 81A. The vertical axis (y-axis) represents the rank of visually checked acute streaks that appear on the toner image IT on the recording medium S. Rank 4 or above defines no acute streaks visually identified.

The experiment was performed at three temperatures of the outer circumferential surface of the fixing roller 51, that is, a given temperature □, a temperature Δ lower than the given temperature □ by 5 degrees centigrade, and a temperature ◇ higher than the given temperature □ by 5 degrees centigrade. As shown in FIG. 11A, with the maximum height of the coating layer 81A of 15 μm Rz or smaller, acute streaks appear at none of the three temperatures of the fixing roller 51. This means that the coating layer 81A having the maximum height of 15 μm Rz or smaller as the surface roughness parameter prevents acute streaks.

FIG. 11B is a graph showing a relation between the ten point average roughness Rzjis and the rank of a caterpillar pattern that appears on the toner image IT on the recording medium S sliding over the coating layer 81A. The horizontal axis (x-axis) represents the ten point average roughness Rzjis of the coating layer 81A. The vertical axis (y-axis) represents the rank of a caterpillar pattern that appears on the toner image IT on the recording medium S. Rank 5 defines no caterpillar pattern appearing on the toner image IT. The coating layer 81A having the ten point average roughness Rzjis of 10 or more prevents a caterpillar pattern.

The experiment results illustrated in FIGS. 11A and 11B show that the coating layer 81A having the maximum height Rz of 15 μm or smaller and the ten point average roughness Rzjis of 10 or greater prevents acute streaks even without the recesses 81*a*, 81*b*, and 81*c*. However, the coating layer 81A made of fluoroplastic may be subject to abrasion by friction between the coating layer 81A and the toner image IT on the recording medium S sliding over the coating layer 81A. To address this circumstance, according to the example embodiments described above, the coating layer 81A has the maximum height Rz of 15 μm or smaller and is produced with the plurality of recesses (e.g., at least two of the recesses 81*a*, 81*b*, and 81*c*), preventing acute streaks and a caterpillar pattern effectively.

Since general coating layers made of fluoroplastic have a thickness of about 30 μm or greater, the maximum depth of each of the recesses 81*a*, 81*b*, and 81*c* may be about 30 μm or greater. It is to be noted that the thickness of the coating layer 81A is exaggerated for purposes of illustration in FIG. 9. Therefore, the depths Da and Db of the recesses 81*a* and 81*b* produced in the coating layer 81A are illustrated smaller relative to the thickness of the coating layer 81A.

With reference to FIGS. 2, 4, 7, and 8, a description is provided of advantages of the fixing devices 5 and 5S.

The fixing device (e.g., the fixing devices 5 and 5S) includes a fixing assembly (e.g., the fixing assemblies 50 and 50A) including a fixing rotary body (e.g., the fixing roller 51 and the fixing belt 51C) rotatable in a given direction of rotation (e.g., the rotation directions R1 and R3); a heater (e.g., the heater 52) disposed opposite and heating the fixing rotary body; a pressing rotary body (e.g., the pressing roller 71) pressed against the fixing rotary body to form the fixing nip N therebetween through which a recording medium S bearing a toner image IT is conveyed; and at least one separator (e.g., the separators 80A, 80A1, 80A2, 80A3, and 80A4) disposed opposite the fixing rotary body to separate the recording medium S discharged from the fixing nip N from the fixing rotary body, thus preventing the recording medium S from being wound around the fixing rotary body. The separator includes the front 80Ab disposed opposite an outer circumferential surface of the fixing rotary body with a given interval (e.g., the slight intervals A and C) therebetween and the conveyance face 80Ac contiguous to the front 80Ab, over which the recording medium S slides.

The separator is coated with the smooth coating layer 81A, made of fluoroplastic, that coats at least the front 80Ab and the conveyance face 80Ac of the separator. A part, that is, the front portion 81Ab of the smooth surface of the coating layer 81A corresponding to the front 80Ab of the separator is produced with the plurality of recesses 81*a*, 81*b*, and 81*c* extending in the width direction W1 of the separator orthogonal to the recording medium conveyance direction DS throughout substantially the entire width of the separator in the width direction W1 thereof.

Accordingly, the plurality of recesses 81*a*, 81*b*, and 81*c* prevents acute streaks, a caterpillar pattern, and variation in gloss of the toner image IT regularly produced in the recording medium conveyance direction DS that may be produced on the toner image IT by the separator as the recording medium S slides over the separator.

According to the example embodiments described above, the pressing roller 71 serves as a pressing rotary body in contact with the fixing roller 51 or the fixing belt 51C. Alternatively, a pressing belt, pressing pad, a pressing plate, or the like may serve as a pressing rotary body.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotary body rotatable in a given direction of rotation;

a pressing rotary body pressed against the fixing rotary body to form a fixing nip therebetween through which a recording medium is conveyed;

a separator disposed downstream from the fixing nip in a recording medium conveyance direction to separate the recording medium discharged from the fixing nip from the fixing rotary body, the separator including:

a front disposed opposite an outer circumferential surface of the fixing rotary body with a given interval therebetween; and a conveyance face contiguous to the front, over which the recording medium slides; and a coating layer, made of fluoroplastic, to coat the front and the conveyance face of the separator, the coating layer including a front portion corresponding to the front of the separator and disposed opposite the recording medium, the front portion produced with a plurality of recesses extending in a width direction of the separator orthogonal to the recording medium conveyance direction throughout substantially an entire width of the separator in the width direction thereof.

2. The fixing device according to claim 1, further comprising a heater disposed opposite and heating the fixing rotary body, wherein the fixing rotary body includes a fixing roller.

3. The fixing device according to claim 1, wherein the fixing rotary body includes an endless fixing belt.

4. The fixing device according to claim 3, further comprising:

a fixing roller pressing against the pressing rotary body via the fixing belt;

a heater disposed opposite and heating the fixing belt; and a heating roller disposed opposite the heater, wherein the fixing belt is stretched across the fixing roller and the heating roller.

5. The fixing device according to claim 1, wherein the pressing rotary body includes a pressing roller.

6. The fixing device according to claim 1, further comprising a support to support the separator and including a plurality of arms projecting from both lateral ends of the support in an axial direction of the fixing rotary body, respectively, toward the fixing rotary body, the arms contacting the fixing rotary body to retain the given interval between the separator and the fixing rotary body.

7. The fixing device according to claim 6, wherein the arms of the support contact the fixing rotary body in non-conveyance spans, where the recording medium is not conveyed, disposed at both lateral ends on the outer circumferential surface of the fixing rotary body in the axial direction thereof.

8. The fixing device according to claim 6, wherein the support includes a bracket.

9. The fixing device according to claim 8, further comprising a pin attached to the bracket and pivotably supporting the separator.

10. The fixing device according to claim 1, wherein each of the plurality of recesses produced in the coating layer is arc-shaped in cross-section.

11. The fixing device according to claim 1, wherein the front portion of the coating layer has a smooth surface having a maximum height not greater than about 15 μm Rz, and wherein each of the plurality of recesses has a depth not smaller than about 30 μm.

12. The fixing device according to claim 1, wherein the front portion of the coating layer includes:

a first slope disposed opposite the fixing rotary body with the given interval therebetween; and a second slope contiguous to and disposed downstream from the first slope in the recording medium conveyance direction, and wherein a first angle formed between the first slope of the coating layer and the conveyance face of the separator in cross-section is greater than a second angle formed between the second slope of the coating layer and the conveyance face of the separator in cross-section.

13. The fixing device according to claim 12, wherein the plurality of recesses includes:

a first recess produced in the first slope and having a first length in the recording medium conveyance direction; and a second recess produced in the second slope and having a second length in the recording medium conveyance direction, and wherein the first length of the first recess is smaller than the second length of the second recess.

14. The fixing device according to claim 13, wherein the first recess has a first depth that is greater than a second depth of the second recess.

15. The fixing device according to claim 1, wherein each of the plurality of recesses is curved to project toward an edge of the separator that is disposed opposite the fixing rotary body.

16. The fixing device according to claim 1, wherein the separator is made of at least one of heat-resistant, rigid resin and metal.

17. An image forming apparatus comprising the fixing device according to claim 1.

18. The fixing device according to claim 1, further comprising another separator.

19. The fixing device according to claim 18, wherein each of the separators has the plurality of recesses.

* * * * *